US009988977B2

(12) United States Patent
Crandall et al.

(10) Patent No.: US 9,988,977 B2
(45) Date of Patent: Jun. 5, 2018

(54) HEAT SHIELD WITH CENTERING FEATURES

(71) Applicant: BorgWarner Inc., Auburn Hills, MI (US)

(72) Inventors: Jerud Crandall, Asheville, NC (US); Gordon Jenks, Chandler, NC (US); Michael Thayer, Asheville, NC (US)

(73) Assignee: BorgWarner Inc., Auburn Hills, MI (US)

( * ) Notice: Subject to any disclaimer, the term of this patent is extended or adjusted under 35 U.S.C. 154(b) by 120 days.

(21) Appl. No.: 14/870,643

(22) Filed: Sep. 30, 2015

(65) Prior Publication Data

US 2016/0102678 A1 Apr. 14, 2016

Related U.S. Application Data

(60) Provisional application No. 62/063,580, filed on Oct. 14, 2014.

(51) Int. Cl.

| | |
|---|---|
| ***F01D 5/04*** | (2006.01) |
| ***F02B 39/14*** | (2006.01) |
| ***F01D 25/18*** | (2006.01) |

(52) U.S. Cl.

CPC ..... *F02B 39/14* (2013.01); *F01D 5/046* (2013.01); *F01D 25/186* (2013.01); *F05D 2220/40* (2013.01); *F05D 2300/6033* (2013.01)

(58) Field of Classification Search

CPC ..... F01D 5/046; F01D 25/145; F01D 5/04; F01D 25/186; F05D 2220/39; F05D 2220/40; F05D 2300/6033; Y02T 10/144; F02C 6/12; F04D 29/624; F02B 39/14

See application file for complete search history.

(56) References Cited

U.S. PATENT DOCUMENTS

| | | | | |
|---|---|---|---|---|
| 8,092,162 | B2 * | 1/2012 | Masson | F02C 6/12 415/177 |
| 8,827,638 | B2 * | 9/2014 | Delitz | F02C 6/12 415/178 |
| 2011/0014036 | A1 * | 1/2011 | Boening | F02C 6/12 415/177 |

(Continued)

FOREIGN PATENT DOCUMENTS

| | | | |
|---|---|---|---|
| CN | 102844542 A | 12/2012 | |
| CN | 103827466 A | 5/2014 | |
| WO | WO 2013041198 A1 * | 3/2013 | F02C 6/12 |

OTHER PUBLICATIONS

Chinese Office Action (with English language translation) dated Feb. 8, 2018, in Chinese Application No. 201510670390.8.

*Primary Examiner* — Logan Kraft
*Assistant Examiner* — Joshua R Beebe
(74) *Attorney, Agent, or Firm* — Eric L. Doyle; Stephan A. Pendorf; Patent Central LLC

(57) ABSTRACT

A turbocharger (10) includes a shaft (26) rotatably supported within a bearing housing (28), a turbine wheel (22) connected to the shaft (26), and a heat shield (150, 250) disposed between the turbine wheel (22) and the bearing housing (28). The heat shield (150, 250) includes surface features (80, 180) formed on at least one of a sidewall (57) portion thereof and a flange (63) portion thereof that locate the heat shield (150, 250) relative to the bearing housing (28) such that the heat shield (150, 250) is coaxial with the rotational axis of the shaft (26).

10 Claims, 5 Drawing Sheets

(56) References Cited

U.S. PATENT DOCUMENTS

| | | | | |
|---|---|---|---|---|
| 2013/0039747 | A1* | 2/2013 | Heidingsfelder ..... | F01D 25/145<br>415/177 |
| 2015/0252689 | A1* | 9/2015 | Burmester ..... | F02C 6/12<br>415/177 |

* cited by examiner

HEAT SHIELD WITH CENTERING FEATURES

BACKGROUND OF THE INVENTION

Field of the Invention

This disclosure relates to an exhaust gas turbocharger for an internal combustion engine. More particularly, this disclosure relates to a heat shield for an exhaust gas turbocharger.

Description of Related Art

A turbocharger is a type of forced induction system used with internal combustion engines. Turbochargers deliver compressed air to an engine intake, allowing more fuel to be combusted, thus boosting the horsepower of the engine without significantly increasing engine weight. Thus, turbochargers permit the use of smaller engines that develop the same amount of horsepower as larger, normally aspirated engines. Using a smaller engine in a vehicle has the desired effect of decreasing the mass of the vehicle, increasing performance, and enhancing fuel economy. Moreover, the use of turbochargers permits more complete combustion of the fuel delivered to the engine, which contributes to the highly desirable goal of a cleaner environment.

Turbochargers typically include a turbine housing connected to the exhaust manifold of the engine, a compressor housing connected to the intake manifold of the engine, and a center bearing housing disposed between and coupling the turbine and compressor housings together. A turbine wheel in the turbine housing is rotatably driven by an inflow of exhaust gas supplied from the exhaust manifold. A shaft is radially supported for rotation in the center bearing housing, and connects the turbine wheel to a compressor impeller in the compressor housing so that rotation of the turbine wheel causes rotation of the compressor impeller. The shaft connecting the turbine wheel and the compressor impeller defines a line which is the axis of rotation. As the compressor impeller rotates, it increases the air mass flow rate, airflow density and air pressure delivered to the cylinders of the engine via the engine intake manifold.

A heat shield is placed between the turbine wheel and the bearing housing. The heat shield is used to shield the bearing housing from the heat of the exhaust gases passing through the turbine housing and driving the turbine wheel. The heat shield includes a central opening that receives the shaft, whereby the heat shield is generally radially centered on the shaft relative to the bearing housing during assembly. However, the central opening is relatively large to permit thermal growth of the heat shield and shaft during operation of the turbocharger. As a result, the heat shield is often imprecisely positioned within the turbocharger during assembly with the bearing housing. When the turbine housing is subsequently assembled on the bearing housing during assembly of the turbocharger, the radial position of the heat shield cannot be determined since the turbine housing provides a visual obstruction, further exacerbating the difficulties in accurately positioning the heat shield within the overall assembly.

SUMMARY

In some aspects, a turbocharger includes a shaft and a turbine wheel connected to the shaft, the turbine wheel including a wheel hub and blades having tips. The turbocharger also includes a heat shield disposed between the turbine wheel and the bearing housing. The heat shield includes a base portion including a central opening for receiving the shaft therethrough, a sidewall portion formed at the radially-outward peripheral edge of the base portion and extending transverse to the base portion, and a flange portion formed at an end of the sidewall portion spaced apart from the base portion, the flange portion extending generally transverse to the sidewall portion. The heat shield includes surface features formed on the sidewall portion or the flange portion that locate the heat shield relative to the bearing housing such that the heat shield is centered on a rotational axis of the shaft. Since the surface features serve to radially locate the heat shield relative to the bearing housing, the heat shield can be accurately positioned during assembly regardless of the dimensions of the central opening and without requiring visualization of the heat shield during assembly of the turbine housing on the bearing housing. In addition, the surface features advantageously provide clearances between the heat shield and the bearing housing in the vicinity of the turbine wheel, which minimize heat conduction to the bearing housing via the heat shield.

In some implementations, the surface features on the heat shield permit the heat shield to be adapted for use on bearing housings having a relatively small diameter turbine-facing side nose. For example, for economic reasons it is advantageous to be able to use variously sized bearing housings with a given turbine housing, which allows full use of all available stock during production. As a result, in some cases, a bearing housing that is of smaller diameter than would normally be matched with the given turbine housing is matched with the given turbine housing. The surface features on the heat shield are configured to permit the heat shield to be accurately centered on the given turbine housing in the event of a size mis-match.

In some aspects, the surface features include an axially protruding ridge that is formed in the flange. The ridge is received within a circumferential groove formed in the bearing housing whereby the heat shield is located relative to the bearing housing.

In some aspects, the surface features include radially inward-extending protrusions that are equidistantly spaced along a circumference of the sidewall. A radially inward-facing surface of the protrusions abuts a radially outward-facing surface of the bearing housing, whereby the heat shield is located relative to the bearing housing.

Advantageously, the heat shields described herein can be formed by a stamping process, whereby manufacturing costs are minimized.

In some aspects, a turbocharger includes a shaft rotatably supported within a bearing housing, a turbine wheel disposed in a turbine housing and connected to the shaft, and a heat shield. The heat shield includes a radially extending base having a central opening that receives the shaft, a radially extending flange that is axially offset from the radially extending base, and an axially-extending sidewall intermediate the base and the flange. The sidewall has a first end connected to a radially-outermost end of the base, and a second end that is opposed to the first end and connected to a radially-innermost end of the flange. The heat shield includes surface features formed on one of the sidewall and the flange that locate the heat shield relative to the bearing housing such that i) the heat shield is centered on a rotational axis of the shaft; ii) there is a first radial clearance between a radially inward-facing surface of the sidewall and the bearing housing; iii) there is an axial clearance between a turbine housing-facing surface of the base and a turbine wheel-facing surface of the bearing housing; and iv) there is a second radial clearance between the central opening and the bearing housing, the shaft, and the turbine wheel.

The turbocharger may include one or more of the following features: The surface features include an axially protruding ridge that is formed in the flange, the ridge being received within a circumferential groove formed in the bearing housing whereby the heat shield is located relative to the bearing housing. The axially protruding ridge is convex on a bearing housing-facing surface of the flange, and concave on a turbine housing-facing surface of the flange. The ridge is continuous in a circumferential direction. The ridge is formed at a location of the flange that adjoins the sidewall. The surface features comprise radially inward-extending protrusions that are spaced apart along a circumference of the sidewall, a radially inward-facing surface of the protrusions abutting a radially outward-facing surface of the bearing housing, whereby the heat shield is located relative to the bearing housing. A dimension of the protrusion in a circumferential direction is small relative to a circumferential dimension of the sidewall. A ratio of a circumferential dimension of the sidewall to a circumferential dimension of the protrusion is in a range of 20 to 100. The protrusions have a V-shape such that contact between each protrusion and the bearing housing occurs along a line.

In some aspects, a turbocharger includes a shaft rotatably supported within a bearing housing, a turbine wheel disposed in a turbine housing and connected to the shaft, and a heat shield. The heat shield includes a radially extending base having a central opening that receives the shaft, a radially extending flange that is axially offset from the radially extending base, and an axially-extending sidewall intermediate the base and the flange. The sidewall has a first end connected to a radially-outermost end of the base, and a second end that is opposed to the first end and connected to a radially-innermost end of the flange. The heat shield includes surface features formed on the flange that locate the heat shield relative to the bearing housing. The surface features include an axially protruding ridge that is formed in the flange, the ridge being received within a circumferential groove formed in the bearing housing whereby the heat shield is located relative to the bearing housing.

The turbocharger may include one or more of the following features: The axially protruding ridge is convex on a bearing housing-facing surface of the flange, and concave on a turbine housing-facing surface of the flange. The ridge is continuous in a circumferential direction.

In some aspects, a turbocharger includes a shaft rotatably supported within a bearing housing, a turbine wheel disposed in a turbine housing and connected to the shaft, and a heat shield. The heat shield includes a radially extending base having a central opening that receives the shaft, a radially extending flange that is axially offset from the radially extending base, and an axially-extending sidewall intermediate the base and the flange. The sidewall has a first end connected to a radially-outermost end of the base, and a second end that is opposed to the first end and connected to a radially-innermost end of the flange. The heat shield includes surface features formed on the sidewall that locate the heat shield relative to the bearing housing. The surface features include radially inward-extending protrusions that are spaced along a circumference of the sidewall, a radially inward-facing surface of the protrusions abutting a radially outward-facing surface of the bearing housing, whereby the heat shield is located relative to the bearing housing.

The turbocharger may include one or more of the following features: A ratio of a circumferential dimension of the sidewall to a circumferential dimension of the protrusion is in a range of 20 to 100. The heat shield includes three protrusions.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION

Figure 1:
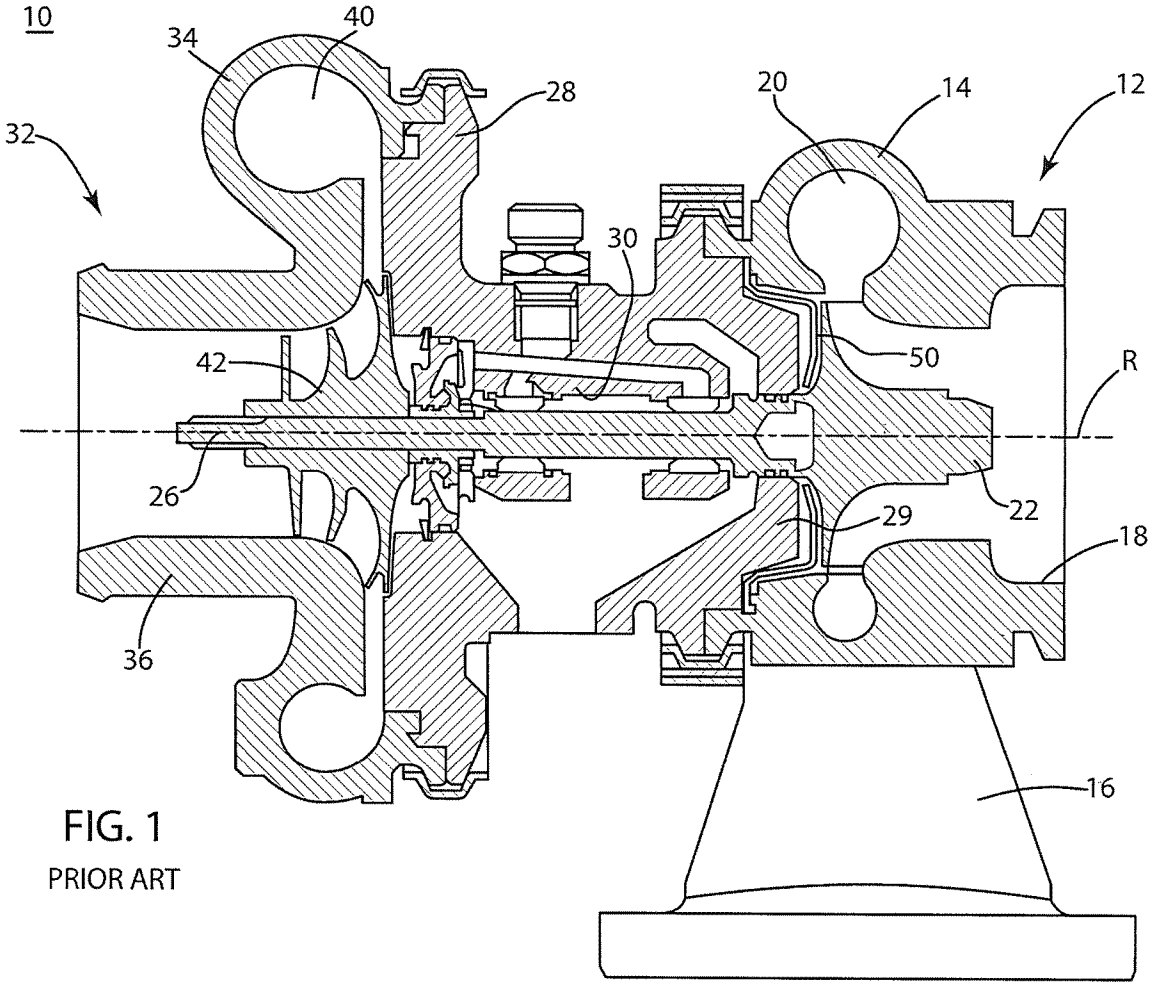
FIG. 1 PRIOR ART
FIG. 1 is cross-sectional view of an exhaust gas turbocharger including a conventional heat shield disposed between the turbine wheel and the bearing housing.

Referring to FIG. 1, an exhaust gas turbocharger 10 includes a turbine section 12, a compressor section 32, and a center bearing housing 28 disposed between and connecting the compressor section 32 to the turbine section 12. The turbine section 12 includes a turbine housing 14 that defines an exhaust gas inlet 16, an exhaust gas outlet 18, and a turbine volute 20 disposed in the fluid path between the exhaust gas inlet 16 and exhaust gas outlet 18. A turbine wheel 22 is disposed in the turbine housing 14 between the turbine volute 20 and the exhaust gas outlet 18. A conventional heat shield 50 is provided in the turbine section 12 between the turbine wheel 22 and the bearing housing 28.

A shaft 26 is connected to the turbine wheel 22, is radially supported for rotation within in a bore 30 formed in the bearing housing 28, and extends into the compressor section 32. The compressor section 32 includes a compressor housing 34 that defines an air inlet 36, an air outlet (not shown), and a compressor volute 40. A compressor wheel 42 is disposed in the compressor housing 34 between the air inlet 36 and the compressor volute 40 and is connected to the shaft 26.

In use, the turbine wheel 22 is rotatably driven by an inflow of exhaust gas supplied from the exhaust manifold of an engine (not shown). Since the shaft 26 connects the turbine wheel 22 to the compressor wheel 42 in the compressor housing 34, the rotation of the turbine wheel 22 causes rotation of the compressor wheel 42. As the compressor wheel 42 rotates, it increases the air mass flow rate, airflow density and air pressure delivered to the engine's cylinders via an outflow from the compressor air outlet, which is connected to the engine's air intake manifold.

The conventional heat shield 50 is a concave part that functions to reduce heat transfer from the turbine section 12 to the bearing housing 28. However, in some turbocharger configurations, such as when a mating portion of the bearing housing is of smaller diameter than would normally be used, and when interruption of the outer surface of the heat shield is to be minimized, an improved heat shield 150 is substituted for the conventional heat shield 50 within the turbocharger 10. The heat shield 150 includes self-centering features which accommodates a relatively smaller diameter mating portion and provides minimal interruption of the outer surface, as described in detail below.

Figure 3:
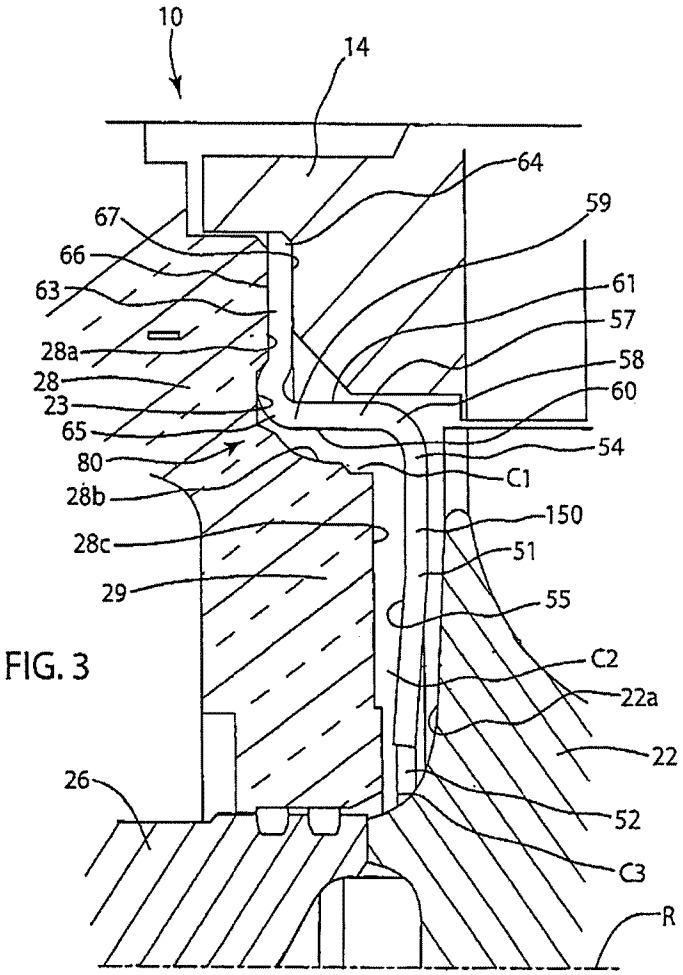
FIG. 3 is a cross-sectional view of a portion of the turbocharger showing the heat shield of FIG. 2 disposed between the turbine wheel and the bearing housing.
Figure 2:
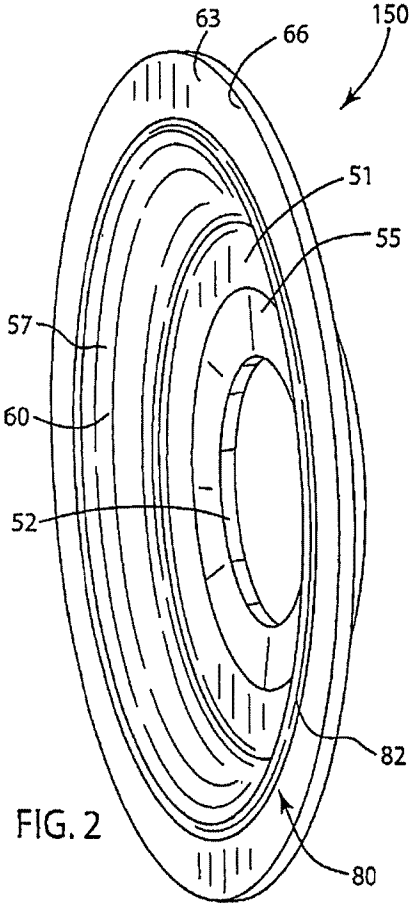
FIG. 2 is a perspective view of a self-centering heat shield.
Figure 4:
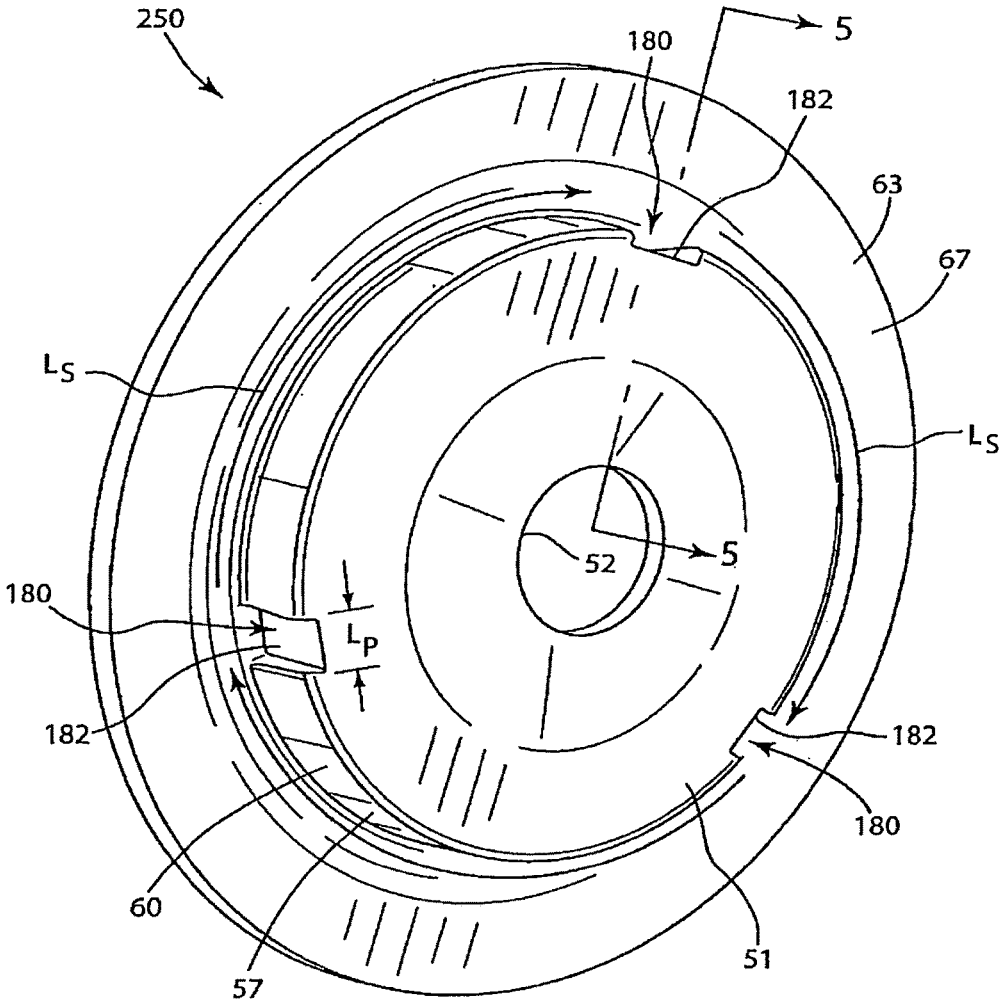
FIG. 4 is a perspective view of another embodiment self-centering heat shield, but with inward-extending protrusions, exaggerated for ease of understanding
Figure 5:
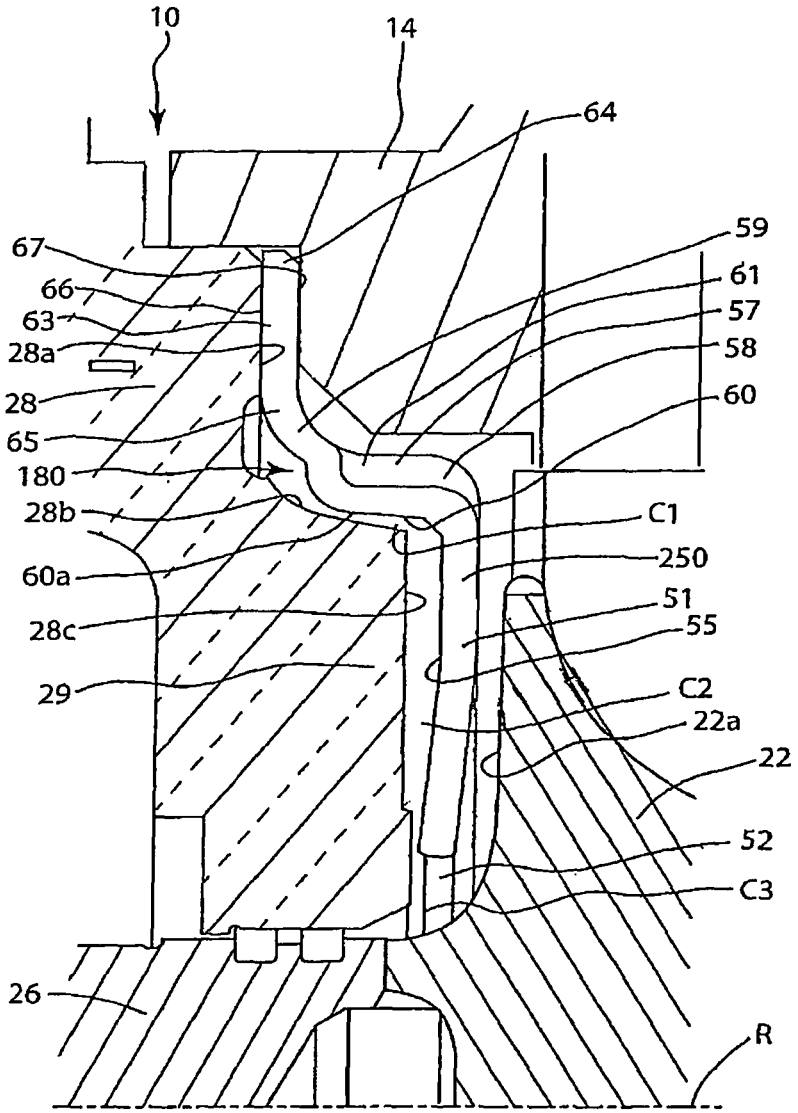
FIG. 5 is a cross-sectional view of a portion of the turbocharger showing the heat shield of FIG. 4 disposed between the turbine wheel and the bearing housing.

Referring to FIGS. 2 and 3, the self-centering heat shield 150 has a shape that is configured to reduce heat transfer from the turbine section 12 to the bearing housing 28, and also to result in self-centering of the heat shield 150 relative to the turbocharger bearing housing 28 so as to be centered on a rotational axis R of the turbocharger shaft 26. In particular, the heat shield 150 has a concave shape that is similar to that of a shallow bowl. The heat shield 150 includes a radially-extending base 51 having a central opening 52 that receives the shaft 26 with generous clearance, a radially-extending flange 63 that is axially offset from the base 51, and a generally axially-extending sidewall 57 disposed intermediate to, and connecting, the base 51 and the flange 63. The term "axial sidewall" as used herein means that the sidewall covers an axial distance, and may be perfectly axial or cylindrical as shown in FIGS. 3 and 5, or conical as shown in FIGS. 2 and 4, or hemispherical, hyperbolic, stepped, or any shape so long as it extends between base 51 and flange 63. To this end, the sidewall 57 has a first end 58 that is connected to a radially outermost end 54 of the base 51, and a second end 59 that is opposed to the first end 58 and connected to a radially-innermost end 65 of the flange 63.

The heat shield 150 includes surface features 80 formed on the flange 63 that locate the heat shield 150 relative to the bearing housing 28. More particularly, the surface features 80 locate the heat shield 150 relative to a bearing housing "nose" 29, which is an axially-protruding portion of the bearing housing 28 that is formed on the turbine housing-facing surface 28*a* and centered on the shaft-receiving bore 30. The nose 29 of the bearing housing 28 includes a radially-outward facing surface 28*b* and an axially-outward facing (turbine wheel-facing) surface 28*c*.

The surface features 80 include an axially-protruding ridge 82 that is formed in the flange 63 so as to protrude toward the bearing housing 28. The ridge 82 is convex on a bearing housing-facing surface 66 of the flange 63, and concave on a turbine housing-facing surface 67 of the flange 63. In the illustrated embodiment, the ridge 82 extends continuously along a circumference of the flange 63, but is not limited to this configuration. For example, in some embodiments, the ridge 82 may be discontinuous along the circumference of the flange 63. In the illustrated embodiment, the ridge 82 is formed at a radially-innermost end 65 of the flange 63 so as to adjoin the sidewall 57, but is not limited to this radial position. For example, in some embodiments, the ridge 82 may be positioned between the flange radially-innermost end 65 and the flange radially-outermost end 64, or positioned adjoining the flange radially-outermost end 64.

The ridge 82 is received within a circumferential groove 23 formed in the turbine housing-facing surface 28*a* of the bearing housing 28 at a location that is radially outward relative to the nose 29. In the illustrated embodiment, the groove 23 adjoins the nose 29, but is not limited to this configuration. The engagement between the ridge 82 and the groove 23 serves to locate the heat shield 150 relative to the bearing housing 28 such that the heat shield 150 is centered on a rotational axis R of the shaft 26.

In addition, the axially-protruding ridge 82, when received within the groove 23, locates the heat shield 150 relative to the bearing housing 28 such that the following clearances exist about the surface of the heat shield 150: A first clearance C1 is a radial clearance that is provided between a radially inward-facing surface 60 of the sidewall and the facing surface 28*b* of the bearing housing nose 29; a second clearance C2 is an axial clearance provided between a bearing housing-facing surface 55 of the base 51 and the turbine wheel-facing surface 28*c* of the bearing housing nose 29; and a third clearance C3 is a radial clearance that is provided between the central opening 52 and the bearing housing 28, the shaft 26, and the turbine wheel 22. The clearances C1, C2, C3 are vacancies that thermally insulate the bearing housing 28 from the heat shield 150 in the vicinity of the bearing housing nose 29 and backface 22*a* of the turbine wheel 22, whereby the efficiency of the heat shield 150 is improved relative to some conventional heat shields.

Referring to FIGS. 4 and 5, an alternative embodiment heat shield 250 has a shape that is configured to reduce heat transfer from the turbine section 12 to the bearing housing 28, and also to result in self-centering of the heat shield 250 relative to the turbocharger bearing housing 28 so as to be centered on a rotational axis R of the turbocharger shaft 26. The self-centering heat shield 250 is similar to the heat shield 150 described above with respect to FIGS. 2 and 3. For this reason, common elements will be referred to with common reference numbers and the description will not be repeated. In particular, the heat shield 250 has a concave shape that is similar to that of a shallow bowl, and includes the radially-extending base 51 having a central opening 52 that receives the shaft 26 with generous clearance, the radially-extending flange 63 that is axially offset from the base 51, and the axially-extending sidewall 57 disposed intermediate to, and connecting, the base 51 and the flange 63.

The heat shield 250 includes surface features 180 formed on the sidewall 57 that locate the heat shield 250 relative to the bearing housing nose 29. The surface features 180 include radially inward-extending protrusions 182 that are equidistantly spaced along a circumference of the sidewall 57. The protrusions 182 are generally rectangular in shape, are convex on the radially inward-facing surface 60 of the sidewall 57, and are concave on the radially outward facing (turbine housing-facing) surface 61 of the sidewall 57. They are shown in exaggerated form in FIG. 4 for ease of understanding of the self-centering feature of the invention.

In order to minimize heat conduction through the heat shield 250 to the bearing housing 28, the dimension of each protrusion 182 in a circumferential direction is small relative to a circumferential dimension of the sidewall 57. For example, the ratio Ls/Lp of a circumferential dimension of the sidewall Ls to the circumferential dimension Lp of the protrusion is in a range of 20 to 100. In the illustrated embodiment, the ratio Ls/Lp is 34. In addition, in the illustrated embodiment, the heat shield includes three protrusions 182, but is not limited to having three protrusions 182.

The radially inward-facing surface 60*a* of the protrusions 182 abut the radially outward-facing surface 28*b* of the bearing housing nose 29, and serve to locate the heat shield 250 relative to the bearing housing 28 such that the heat shield 150 is centered on a rotational axis R of the shaft 26.

In addition, the protrusions 182 locate the heat shield 250 relative to the bearing housing 28 such that the clearances C1, C2, C3 exist about the surface of the heat shield 250. In particular, the first clearance C1 is a radial clearance that is provided between the radially inward-facing surface 60 of the sidewall and the facing surface 28*b* of the bearing housing nose 29. In this embodiment, the first clearance C1 is defined in the circumferentially-extending space between adjacent protrusions 182. As in the previously described embodiment, the second clearance C2 is an axial clearance provided between a bearing housing-facing surface 55 of the base 51 and the turbine wheel-facing surface 28*c* of the bearing housing nose 29; and the third clearance C3 is a radial clearance that is provided between the central opening 52 and the bearing housing 28, the shaft 26, and the turbine wheel 22. The clearances C1, C2, C3 are vacancies that thermally insulate the bearing housing 28 from the heat shield 150 in the vicinity of the bearing housing nose 29 and backface 22*a* of the turbine wheel 22, whereby the efficiency of the heat shield 250 is improved relative to some conventional heat shields.

Figure 6:
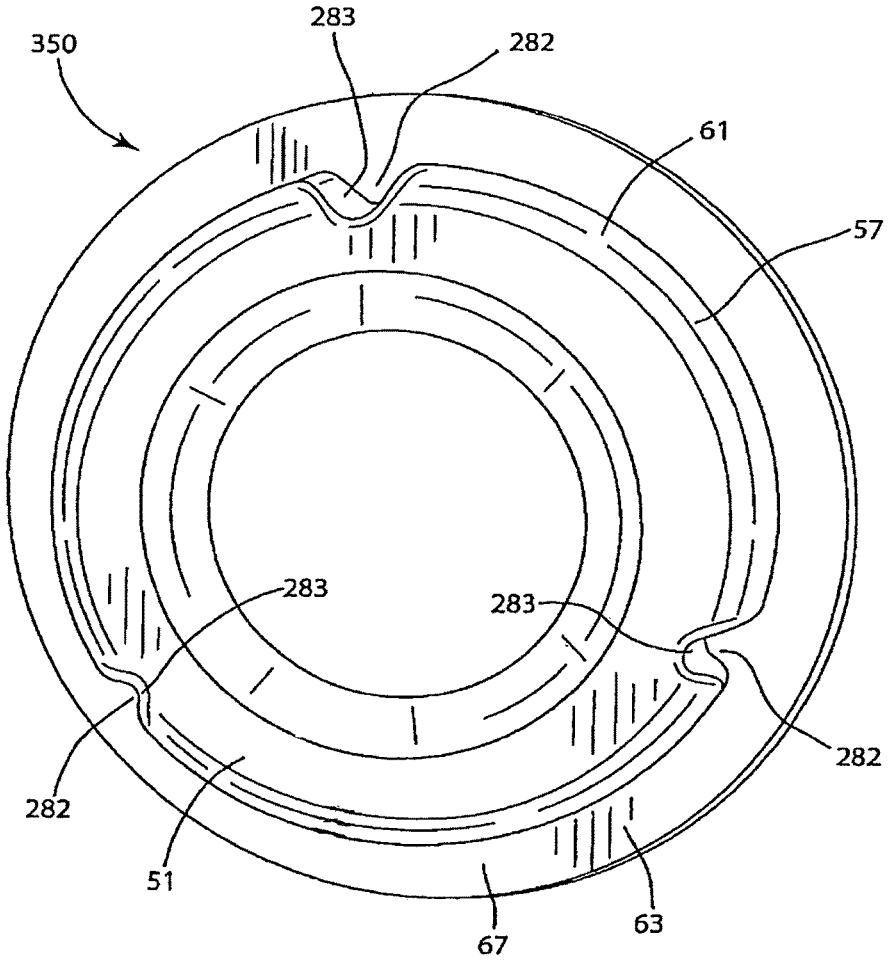
FIG. 6 is a perspective view of another embodiment of a self-centering heat shield with exaggerated inward-extending protrusions.

Referring to FIG. 6, although the protrusions 182 are described as being generally rectangular in shape, whereby the contact between the radially inward-facing surface 60*a* of the protrusions 182 and the bearing housing nose 29 occurs over a generally rectangular area, the protrusions 182 are not limited to this shape. For example, in some embodiments, a self-centering heat shield 350 includes radially inward-extending protrusions 282 that are equidistantly spaced along a circumference of the sidewall 57. The protrusions 282 are generally V-shaped, are convex on the radially inward-facing surface 60 of the sidewall 57, and are concave on the radially outward, or turbine housing-facing, surface 61 of the sidewall 57. In addition, the contact between the radially inward-facing surface 60*a* of the protrusions 282 and the bearing housing nose 29 occurs over a line corresponding to the apex 283 of the V-shaped surface. In another example (not illustrated), the protrusions 182 have a conical shape, whereby the contact between the radially inward-facing surface 60*a* of the protrusions 182 and the bearing housing nose 29 occurs at a point corresponding to the apex of the conical surface.

Although the protrusions 182, 282 are described herein as being equidistantly spaced apart, they are not limited to this configuration. For example, in some embodiments the protrusions 182, 282 are spaced apart such that the distance between some adjacent protrusions 182, 282 is different than between other adjacent protrusions 182, 282.

While the disclosure has been shown and described with respect to the exemplary embodiments, it will be understood by those skilled in the art that various changes and modifications may be made without departing from the scope of the present invention as defined in the following claims.

What is claimed is:

1. A turbocharger (10) comprising
- a bearing housing (28),
- a shaft (26) rotatably supported within the bearing housing (28),
- a turbine housing (14) connected to the bearing housing (28),
- a turbine wheel (22) disposed in the turbine housing (14) and connected to the shaft (26), and
- a heat shield (150) including
  - a radially extending base (51) having a central opening (52) that receives the shaft (26),
  - a radially extending flange (63) that is axially offset from the radially extending base (51), and
  - a sidewall (57) extending between the base (51) and the flange (63), the sidewall (57) having
    - a first end (58) connected to a radially-outermost end of the base (51), and
  - a second end (59) that is opposed to the first end (58) and connected to a radially-innermost end (65) of the flange (63), wherein the heat shield (150) includes surface features (80) formed on the flange (63) that locate the heat shield (150) relative to the bearing housing (28), the surface features (80) comprising an axially protruding ridge (82) that is formed in the flange (63), the ridge (82) being received within a circumferential groove (23) formed in the bearing housing (28) whereby the heat shield (150) is located relative to the bearing housing (28) such that the heat shield (150, 250) is co-axial with the rotational axis of the shaft (26).

2. The turbocharger (10) of claim 1, wherein the axially protruding ridge (82) is convex on a bearing housing-facing surface (66) of the flange (63), and concave on a turbine housing-facing surface (67) of the flange (63).

3. The turbocharger (10) of claim 1, wherein the ridge (82) is continuous in a circumferential direction.

4. The turbocharger (10) of claim 1, wherein the ridge (82) is formed at a location of the flange (63) that adjoins the sidewall (57).

5. The turbocharger (10) of claim 1, wherein the bearing housing (28) includes a nose (29) on the turbine housing-facing surface (28*a*) of the bearing housing (28), axially protruding towards the turbine housing (14) and centered on a shaft-receiving bore (30), and wherein a radial clearance is provided between the central opening (52) of the heat shield (150) and the bearing housing nose (29).

6. A turbocharger (10) comprising
- a bearing housing (28),
- a shaft (26) rotatably supported within the bearing housing (28),
- a turbine housing (14) connected to the bearing housing (28),
- a turbine wheel (22) disposed in the turbine housing (14) and connected to the shaft (26), and
- a heat shield (250) including
  - a radially extending base (51) having a central opening (52) that receives the shaft (26),
  - a radially extending flange (63) that is axially offset from the radially extending base (51), and
  - a sidewall (57) extending between the base (51) and the flange (63), the sidewall (57) having
    - a first end (58) connected to a radially-outermost end of the base (51), and
  - a second end (59) that is opposed to the first end (58) and connected to a radially-innermost end (65) of the flange (63), wherein the heat shield (250) includes surface features (180) formed on the sidewall (57) that locate the heat shield (250) relative to the bearing housing (28), the surface features (180) including radially inward-extending protrusions (182,282) that are spaced along a circumference of the sidewall (57), a radially inward-facing surface (60*a*) of the protrusions (182,282) abutting a radially outward-facing surface (28*b*) of the bearing housing (28), whereby the heat shield (250) is located relative to the bearing housing (28) such that the heat shield (150, 250) is co-axial with the rotational axis of the shaft (26).

7. The turbocharger (10) of claim 6, wherein a ratio (Ls/Lp) of a circumferential dimension (Ls) of the sidewall (57) to a circumferential dimension (Lp) of the protrusion (182) is in a range of 20 to 100.

8. The turbocharger (10) of claim 6, wherein the heat shield (250) includes three protrusions (182,282).

9. The turbocharger (10) of claim 6, wherein a dimension (Lp) of the protrusion (182,282) in a circumferential direction is less than 10% of a circumferential dimension (Ls) of the sidewall (57) without protrusion.

10. The turbocharger (10) of claim 6, wherein the bearing housing (28) includes a nose (29) on the turbine housing-facing surface (28*a*) of the bearing housing (28), axially protruding towards the turbine housing (14) and centered on a shaft-receiving bore (30), and wherein a radial clearance is provided between the central opening (52) of the heat shield (250) and the bearing housing nose (29).

* * * * *